US005083904A

United States Patent [19]

Masatsugu et al.

[11] Patent Number: 5,083,904

[45] Date of Patent: Jan. 28, 1992

[54] KNOCKED-DOWN FAN FOR ENGINE COOLING AND OTHER APPLICATIONS

[75] Inventors: Tomomi Masatsugu, Kohbe; Yoshiaki Matoba, Kakogawa; Tomoharu Nonaka, Mouka, all of Japan

[73] Assignees: Shin Caterpillar Mitsubishi Ltd.; Hoei Kogyo Kabushiki Kaisha, both of Tokyo, Japan

[21] Appl. No.: 619,486

[22] Filed: Nov. 29, 1990

Related U.S. Application Data

[63] Continuation-in-part of Ser. No. 422,221, Oct. 16, 1989, abandoned.

[30] Foreign Application Priority Data

Oct. 18, 1988 [JP] Japan ..... 63-135007
Dec. 13, 1988 [JP] Japan ..... 63-160816

[51] Int. Cl.[5] ..... F01D 5/14

[52] U.S. Cl. ..... 416/212 R; 416/204 R; 416/DIG. 3

[58] Field of Search ..... 416/212 R, 244 R, 200 R, 416/204 R, DIG. 3

[56] References Cited

U.S. PATENT DOCUMENTS 1,372,414 3/1921 Ford ..... 416/212
4,172,691 10/1979 Comstock et al. ..... 416/DIG. 3

*Primary Examiner*—John T. Kwon
*Attorney, Agent, or Firm*—Wegner, Cantor, Mueller & Player

[57] ABSTRACT

An engine cooling-system fan formed by combining two fan assemblies of like construction. Each fan assembly comprises a sheet-metal hub with radiating spokes, and a set of fan blades fastened one to each spoke. The hubs of both fan assemblies are riveted or otherwise joined together in axial alignment, with the two sets of fan blades arranged alternately at constant angular spacings. Preferably, the spokes of either or both of the fan assemblies are offset to provide the same plane of rotation for the two sets of the fan blades.

4 Claims, 5 Drawing Sheets

KNOCKED-DOWN FAN FOR ENGINE COOLING AND OTHER APPLICATIONS

BACKGROUND OF THE INVENTION

This application is a continuation-in-part of copending application Ser. No. 07/422,221 filed Oct. 16, 1989 now abandoned.

This invention relates generally to fans, and particularly to those of the class used for engine cooling and like applications. Still more particularly, the invention pertains to a fan of novel knock-down construction designed for the ease of assemblage and high performance characteristics.

By the term "fan" as used herein and in the claims attached hereto is meant any propeller-type device for imparting motion and acceleration to air or other gases and operating on the centrifugal principle. Thus the invention should be construed to comprehend devices that may be commonly classified as blowers.

Internal-combustion engines such as those used on motor vehicles are normally equipped with a fan as a part of the engine-cooling system. Normally mounted on the water-pump shaft driven from the engine via a fan belt, the engine fan functions to provide a powerful draft of air through the radiator. A typical construction of the engine fan has been such that a set of fan blades have been riveted respectively to arms or spokes radiating from a hub. The hub and spokes may be a unitary piece of sheet metal.

This type of engine fan, as so far constructed, has had some shortcomings. Such shortcomings arise from the fact that the fan blades should not overlap, as seen in a front view, to such an extent as to interfere with the riveting of the successive blades to the spokes. Limitations have therefore been imposed on the shape, size and number of fan blades that could be employed. The number of fan blades has had to be reduced if they are each increased in size for higher rates of air delivery. Conversely, if the number of fan blades is increased, the size of each blade has had to be reduced.

Such limitations on the prior art have made it difficult to make the rate of air delivery as high as can be desired, and the air pressure has been easy to pulsate. It might be contemplated to drive the fan at higher speeds for higher rates of air delivery. This solution would not be realistic because, driven at high speeds, the engine fan would generate inconveniently large amounts of vibrations and noise, particularly if it had a relatively small number of blades.

SUMMARY OF THE INVENTION

The present invention provides a fan of novel knocked-down construction whereby any desired practical number or size of fan blades can be employed without the possibility of interfering with the assemblage of fan.

Briefly, the invention may be summarized as a knocked-down fan for engine cooling and other applications, comprising at least two fan assemblies of like construction. Each fan assembly comprises hub means having an axis of rotation, and a plurality of fan blades riveted or otherwise attached radially to the hub means with equal angular spacings between the fan blades. The fan assemblies are combined by having their hub means joined together, typically by riveting, in axial alignment and with the fan assemblies angularly displaced from each other by half the pitch of the fan blades of each fan assembly.

The fan blades are to be riveted to the hub means of the two separate fan assemblies before they are joined together. In each such fan assembly the angular distances between the fan blades are twice as much as those between the fan blades of the completed fan. Each blade can therefore be riveted to the hub means of each fan assembly without being hampered by the neighboring blades. Thus the fan can be readily assembled with use of practically any desired number or size of blades to provide a desired rate of air delivery at constant pressure.

Typically, the hub means of each fan assembly takes the form of a sheet-metal hub integral with radiating spokes each having one blade riveted thereto. The spokes of at least either of the two fan assemblies may be offset into coplanar relation with those of the other fan assembly so that the blades of the two combined fan assemblies may rotate in one and the same plane. The performance of the resulting fan will then be totally free from any adverse effect that might be feared to arise from the joining of the two fan assemblies in axial alignment.

Preferably, the spokes of both fan assemblies may be offset toward each other to an extent equal to half the thickness of the sheet metal of which the hubs and spokes are made. This alternative is preferred because the two fan assemblies can be exactly alike in construction. Such fan assemblies of identical construction are of course manufacturable much less inexpensively than if a difference exists therebetween, no matter how slight the difference may be.

The above and other features and advantages of this invention and the manner of realizing them will become more apparent, and the invention itself will best be understood, from a study of the following description and appended claims, with reference had to the attached drawings showing some preferred embodiments of the invention.

DESCRIPTION OF THE PREFERRED EMBODIMENTS

The knocked-down fan of this invention will now be described more specifically as adapted for use as an engine cooling-system fan. Generally designated 10 in FIG. 1, the knocked-down engine fan exemplifying the invention is shown as a combination of two fan assemblies 12 and 12' of like construction disposed one behind the other. The front fan assembly 12 is shown by itself in FIG. 2, and the rear fan assembly 12' in FIG. 3. It will be seen that FIGS. 2 and 3 show the fan assemblies 12 and 12' in the same angular positions about their axes as they are depicted in FIG. 1.

Figure 2:
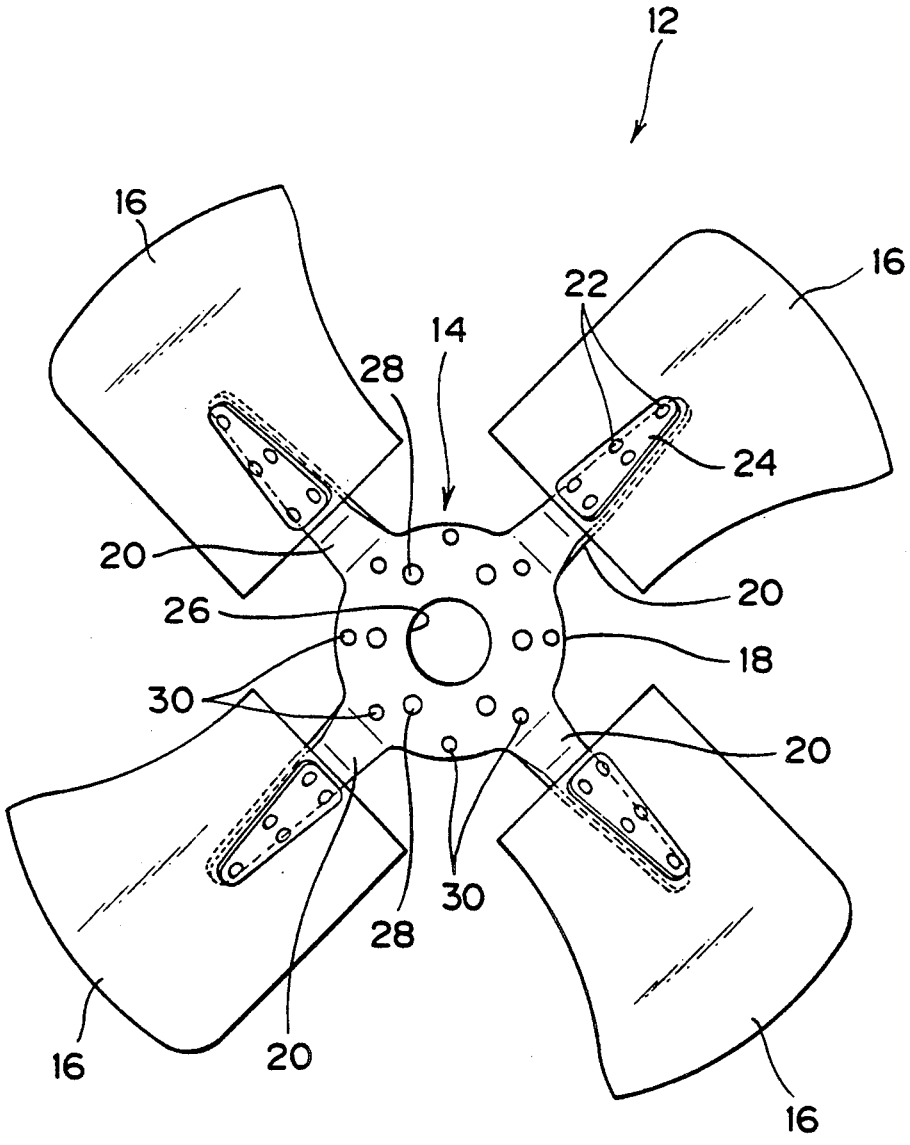
FIG. 2 is a front elevation of the front fan assembly of the engine fan.
Figure 3:
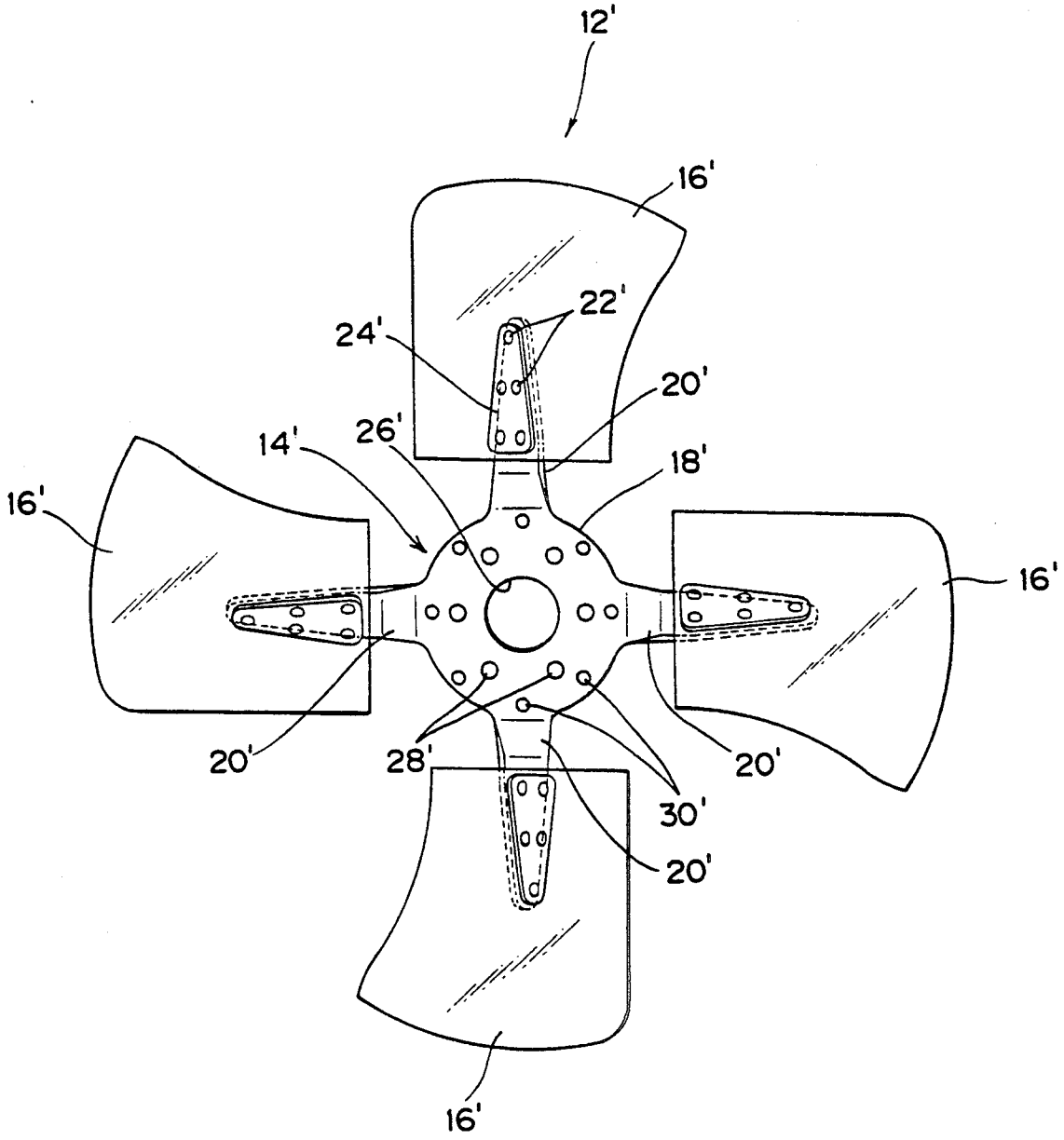
FIG. 3 is a front elevation of the rear fan assembly of the engine fan.

As will be understood from FIG. 2, the front fan assembly 12 comprises a hub member 14 known to the specialists as a spider because of the resemblance of its appearance, and a plurality of, four in this embodiment, fan blades 16 fastened to the spider 14. This spider takes the form of a sheet-metal punching integrally comprising a hub 18 and a set of four arms or spokes 20 extending radially from the hub with a constant angular pitch spacing of 90 degrees. The fan blades 16 are riveted at 22 to the respective hub spokes 20 via sheet-metal retainers 24, with each fan blade engaged between one hub spoke 20 and one retainer 24.

Figure 1:
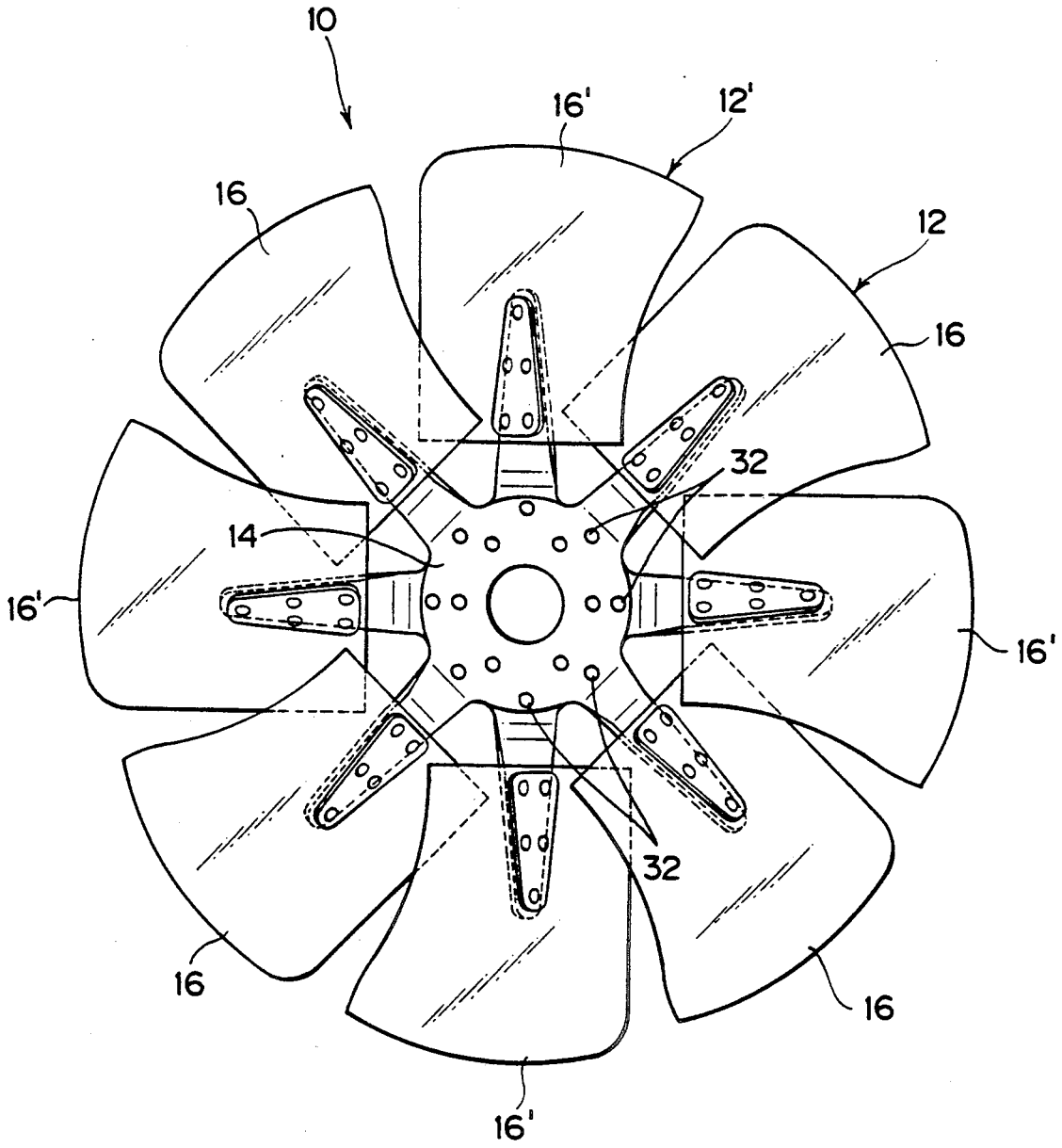
FIG. 1 is a front elevation of a knocked-down engine fan embodying the principles of this invention, the fan comprising two fan assemblies disposed one behind the other in axial alignment.

It will be appreciated that the four fan blades 16 of the front fan assembly 12 employed in this embodiment are angularly spaced from one another much more widely than the eight fan blades of the complete fan 10 of FIG. 1. Therefore, if the fan blades 16 are riveted to the hub spokes 20 before the two fan assemblies 12 and 12' are joined together, the riveting of each fan blade will not be hampered by the neighboring fan blades of the same fan assembly. It will also be understood that the width, or dimension in the circumferential direction of the fan, of each fan blade 16 can be far greater than if the fan 10 were not divided into the two separate assemblies 12 and 12', as has been the case heretofore.

The hub 18 has a mounting hole 26 of relatively large diameter formed centrally therethrough for use in mounting the fan 10 on, for example, the water-pump shaft of an internal-combustion engine. An annular row of six additional mounting holes 28 of smaller diameter are formed concentrically around the central mounting hole 26 for use in fastening the fan 10 to, for example, a fan pulley on the water-pump shaft. Another annular row of eight holes 30 in the hub 18, also centered about the hub axis, are rivet holes for use in fastening together the two fan assemblies 12 and 12'.

Despite the showing of FIG. 2, it is not essential that the holes 26, 28 and 30 be formed in the hub 18 before the front fan assembly 12 is combined with the rear fan assembly 12' as in FIG. 1. The rivet holes 30, in particular, should preferably be formed after the two fan assemblies 12 and 12' are held together in the correct axial and angular positions as in FIG. 1, in order to firmly unite the fan assemblies in the required relative positions.

The construction of the front fan assembly 12 as so far described with reference to FIG. 2 applies to that of the rear fan assembly 12' illustrated in FIG. 3. Therefore, in this and other drawings, the various parts of the rear fan assembly 12' are indicated by priming the reference numerals used to denote the corresponding parts of the front fan assembly 12. No repeated explanation of such parts of the rear fan assembly 12' is considered necessary.

Figure 4:
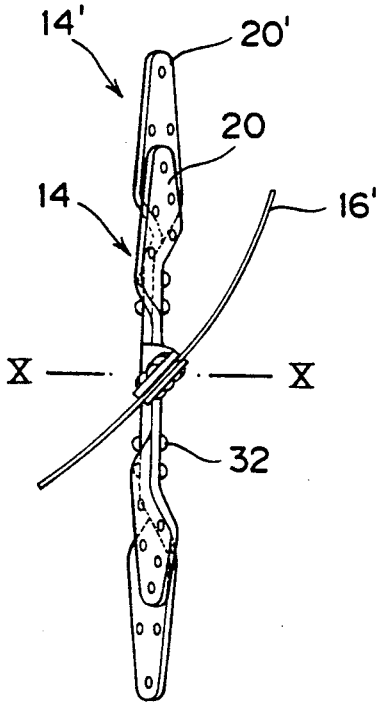
FIG. 4 is a side elevation of the sheet-metal hub members or spiders of the engine fan, shown together with only one of the fan blades attached thereto for illustrative convenience.

As will be understood by referring back to FIG. 1, taken together with FIG. 4, the two fan assembly 12 and 12' are fastened together by rivets 32 passing through the rivet holes 30 and 30' in the hubs 18 and 18'. The fan assemblies are united in alignment about the hub axis X—X but with an angular difference equal to half the pitch of the fan blades 16 and 16' of each fan assembly. Since each fan assembly 12 or 12' has four blades with a pitch angle of 90 degrees in this particular embodiment, the two fan assemblies 12 and 12' are joined with an angular displacement of 45 degrees from each other about the hub axis X—X, providing a total of eight fan blades 16 and 16' with an equal pitch spacing of 45 degrees.

Incidentally, FIG. 4 shows only the spiders 14 and 14' of the fan assemblies 12 and 12' in their correct relative positions, together with only fan blade 16' in order to reveal the twist imparted to each hub spoke 20 or 20'. Such twist of the hub spokes 20 and 20', and the resulting angles of the fan blades 16 and 16' with respect to the principal plane of the fan 10, is of course needed for the air-moving function of the fan.

Although the two fan assemblies 12 and 12' are essentially alike in construction, a slight difference exists in this embodiment in order to make the fan blades 16 and 16' of both fan assemblies rotate in one and the same plane. Toward this end the hub spokes 20' of the rear fan assembly 12' are offset into coplanar relation with the hub spokes 20 of the front fan assembly 12, as discussed in more detail in the following.

Figure 5:
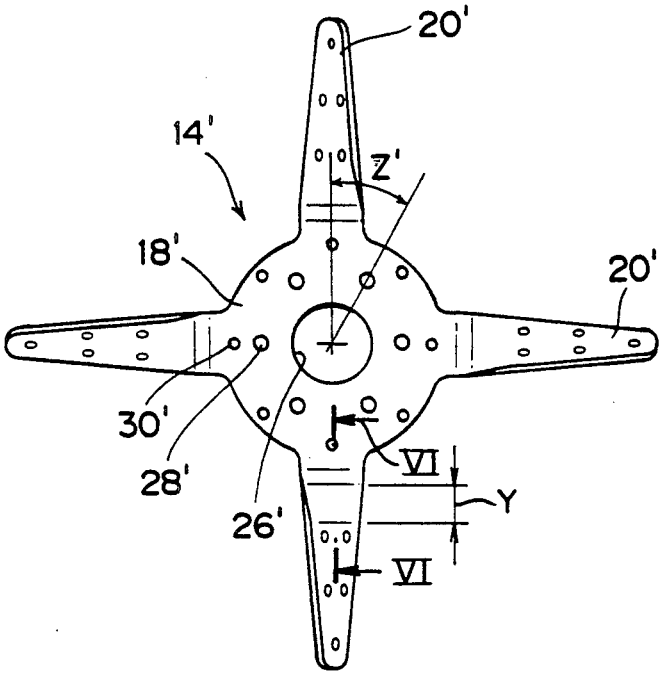
FIG. 5 is a front elevation of the spider of the rear fan assembly of FIG. 3.
Figure 6:
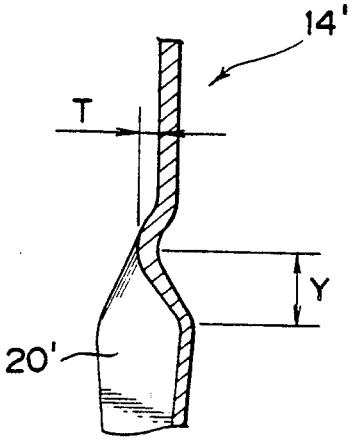
FIG. 6 is an enlarged fragmentary section through the spider of FIG. 5, taken along the line VI—VI therein.

As will be noted from FIGS. 5 and 6, the hub spokes 20' of the rear fan assembly 12' are each twisted at its region Y, in the immediate vicinity of the hub 18', to hold the associated fan blade 16' at the required angle set forth with reference to FIG. 4. At this twisted part Y each hub spoke 20' is offset forwardly a distance equal to the thickness T of the sheet metal of which the spiders 14 and 14' are made, into coplanar relation with the hub spokes 20 of the front fan assembly 12. With the hub spokes 20 and 20' of the two fan assemblies 12 and 12' thus disposed in coplanar relation to each other, the fan blades 16 and 16' rotate in the same plane just like those of the conventional undivided fan. It will, of course, be understood that the hub spokes 20 of the front fan assembly 12 could be offset into coplanar relation with the hub spokes 20' of the rear fan assembly 12'.

Preferably, however, the hub spokes 20 and 20' of both, rather than either, of the fan assemblies 12 and 12' may be offset into coplanar relation with each other. This alternative is preferred because then both fan assemblies 12 and 12' can be exactly alike in construction, making possible the easier mass production of fans at reduced costs.

Figure 7:
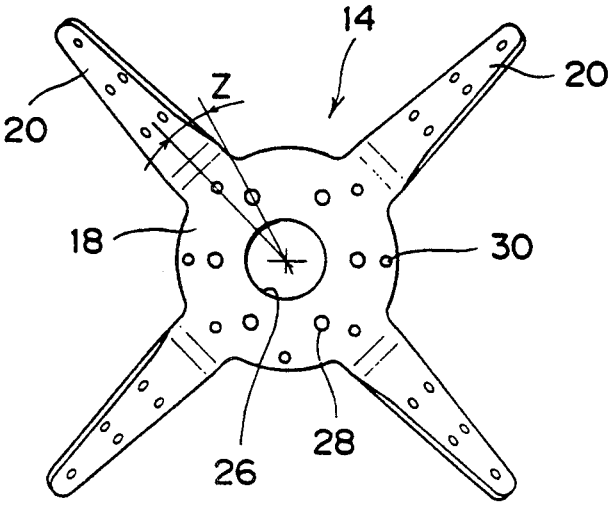
FIG. 7A is a side elevation of one of the spokes of the spider of the front or rear fan assembly.
FIG. 7B is an enlarged elevation of that part of the spoke of FIG. 7A which is indicated by the circle designated 7B.
Figure 7A:
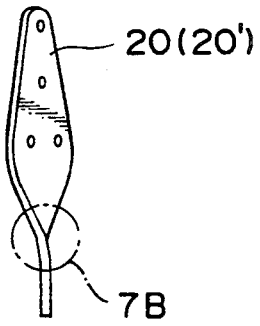
Figure 7B:
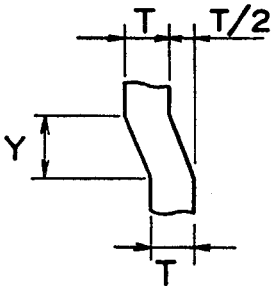

FIGS. 7A and 7B illustrate how to offset the hub spokes 20 and 20' of both fan assemblies 12 and 12'. It will be seen that each hub spoke 20 or 20' is offset at its twisted part Y a distance equal to half the thickness T of the sheet metal of which the spiders 14 and 14' are made. So constructed, the spiders 14 and 14' may be held against each other to bring their offset spokes 20 and 20' into coplanar, interdigitating relation.

A reference back to FIGS. 1–3 will reveal that each fan blade 16 or 16' illustrated therein is not of bilateral symmetry with respect to its centerline extending radially of the spider 14 or 14'. Therefore, in the fan assemblies 12 and 12' constructed in accordance with the teachings of FIGS. 7A and 7B, the two sets of fan blades 16 and 16' must be riveted in the opposite directions to the hub spokes 20 and 20'. No such discrimination between the two sets of fan blades 16 and 16' will be necessary in cases where the fan blades in use are of bilateral symmetry.

As has been mentioned, the mounting holes 26, 26', 28 and 28' and rivet holes 30 and 30' may not necessarily be formed in the hubs 18 and 18' before the fan assemblies 12 and 12' are united as shown in FIG. 1. Only the central mounting holes 26 and 26' may be preformed in the hubs 18 and 18' to facilitate the boring and other operations to be performed subsequently on the hubs.

Figure 8:
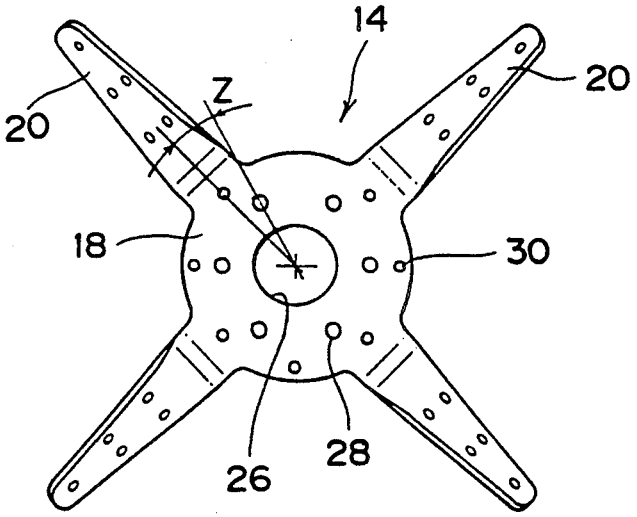
FIG. 8 is a front elevation of the spider of the front fan assembly of FIG. 2.

However, in some instances, it may be desirable to preform all such holes in the hubs 18 and 18', as in the quantity production of the fan assemblies 12 and 12' including those to be held in sock for future use as replacements. In such cases the holes may be arranged as shown in FIG. 5 in the hub 18' of the rear fan assembly 12' and as shown in FIG. 8 in the hub 18 of the front fan assembly 12. Since each hub has four spokes in this embodiment, the eight rivet holes 30 and 30' can be of the same arrangement in each hub 18, 18'. The arrangement of the six mounting holes 28, 28' must differ between the hubs 18 and 18'. The angle Z, FIG. 8, between one of the mounting holes 28 in the hub 18 and the centerline of the adjacent spoke 20 is 15 degrees whereas the angle Z', FIG. 5, between one of the mounting holes 28' in the hub 18' and the centerline of the adjacent spoke 20' is 30 degrees.

Although the present invention has been shown and described in very specific aspects thereof and as embodied in engine cooling-system fans, it is not desired that the invention be limited by the exact details of the illustrated embodiments. For example, three or more, instead of two, fan assemblies could be combined into a single fan. The number of fan blades of each fan assembly could also be greater or smaller than four. Still further, the two or more fan assemblies could be united by means other than riveting, such as screwing, bolting, welding, adhesion, etc. The knocked-down fan of this invention may not include any means for joining the fan assemblies if they are welded together. All such and additional modifications, alterations or adaptations of the invention may be resorted to without departing from the proper scope or fair meaning of the following claims.

What is claimed is:

1. A knocked-down fan for engine cooling and other applications, comprising:

at least two fan assemblies of like construction, each fan assembly comprising hub means having an axis of rotation, each of said hub means comprising a hub and a plurality of spokes each having one fan balde attached thereto and extending radially from the hub, the fan blades having equal angular spacings therebetween;

wherein the hub means of the fan assemblies are joined together in axial alignment, with the fan assemblies angularly displaced from each other by half the pitch of the fan blades of each fan assembly; and wherein the spokes of the hub means of one of the fan assemblies are offset into coplanar relation with the spokes of the hub means of the other fan assembly whereby the fan blades of the fan assemblies rotate in the same plane.

2. A knocked-down fan formed by combining two fan assemblies of like construction, each fan assembly comprising:

(a) a spider comprising a hub and a plurality of spokes extending radially from the hub; and (b) a plurality of fan blades mounted one to each spoke of the spider;

wherein the hubs of the spiders of both fan assemblies are firmly joined together in axial alignment;

wherein the spider of each fan assembly is fabricated from sheet metal, and wherein the spokes of the spider of one of the fan assemblies are offset toward the other fan assembly a distance equal to the thickness of the sheet metal whereby the spokes of both fan assemblies are in the same plane at right angles with the axis of the fan.

3. A knocked-down fan for engine cooling and other applications, comprising:

(a) at least two fan assemblies of like construction, each fan assembly comprising hub means having an axis of rotation, and a plurality of fan blades attached radially to the hub means with equal angular spacings between the fan blades;

(b) the hub means of the fan assemblies being joined together in axial alignment, with the fan assemblies angularly displaced from each other by half the pitch of the fan blades of each fan assembly;

(c) the hub means of each fan assembly comprising a hub and a plurality of spokes extending radially from the hub, each spoke having one fan blade attached thereto, the spokes of the hub means of both the fan assemblies being offset into coplanar relation with one another whereby the fan blades of the fan assemblies rotate in one and the same plane.

4. A knocked-down fan formed by combining two fan assemblies of like construction, each fan assembly comprising:

(a) a spider comprising a hub and a plurality of spokes extending radially from the hub; and (b) a plurality of fan blades mounted one to each spoke of the spider;

(c) the hubs of the spiders of both fan assemblies being firmly joined together in axial alignment;

(d) the spider of each fan assembly being fabricated from sheet metal, and the spokes of the spider of each fan assembly being offset toward the other fan assembly a distance equal to half the thickness of the sheet metal whereby the spokes of both fan assemblies are in the same plane at right angles with the axis of the fan.

* * * * *